United States Patent [19]

Galloup et al.

[11] 4,380,111

[45] Apr. 19, 1983

[54] CUTTING, STRIPPING AND WRAPPING BIT

[75] Inventors: Clifford L. Galloup; Roger M. Bula, both of Reed City; Robert W. Klemm, Hersey; Ralph E. Westerburg, Jr., Reed City, all of Mich.

[73] Assignee: Cooper Industries, Inc., Houston, Tex.

[21] Appl. No.: 184,763

[22] Filed: Sep. 8, 1980

[51] Int. Cl.[3] ..... H01R 43/04; B21F 15/04

[52] U.S. Cl. ..... 29/564.4; 140/124

[58] Field of Search ..... 29/564.4, 751, 33 F, 29/33 M, 566.1, 566.3; 140/124, 122; 81/9.5 R

[56] References Cited

U.S. PATENT DOCUMENTS

| | | | |
|---|---|---|---|
| 2,758,797 | 8/1956 | Miklau | 242/7 |
| 2,807,810 | 10/1957 | Belek et al. | 7/14.1 |
| 3,023,484 | 3/1962 | Arens et al. | 29/33 |
| 3,078,052 | 2/1963 | Olds et al. | 242/7 |
| 3,327,374 | 6/1967 | Lulick et al. | 29/751 X |
| 3,554,243 | 1/1971 | DeRose et al. | 140/124 |
| 3,561,687 | 2/1971 | Bergmann | 242/7.17 |
| 3,696,482 | 10/1972 | Tumilty | 29/33 F |
| 3,781,932 | 1/1974 | Baker et al. | 7/14.1 |
| 3,829,951 | 8/1974 | Nagayama | 29/203 |
| 3,893,491 | 7/1975 | Jackson et al. | 140/122 |
| 3,903,936 | 9/1975 | Bergmann | 140/124 |
| 4,076,056 | 2/1978 | Dummel | 140/119 |
| 4,221,042 | 9/1980 | Aida et al. | 29/564.4 |

*Primary Examiner*—William R. Briggs

*Attorney, Agent, or Firm*—Eddie E. Scott; Michael D. McCully

[57] ABSTRACT

A combination bit for cutting and stripping insulation from a solid flexible conductor wire and wrapping a stripped end portion of the wire on a terminal in a series of helical convolutions includes a cooperable sleeve having a wall portion forming a guide surface for permitting insertion of the wire into a groove formed on the periphery of the bit. A cutting blade disposed in the groove includes opposed straight cutting edge portions one of which is proportioned such that it engages the insulation of the conductor wire initially in a position which places said edge parallel to a cooperative flat surface portion on said sleeve and tangent to the circumference of the wire insulation. The bit and sleeve are proportioned so as to provide for initial engagement of the insulation by the conductor wire within approximately five degrees of angular rotation of the bit from its starting point.

14 Claims, 6 Drawing Figures

CUTTING, STRIPPING AND WRAPPING BIT

BACKGROUND OF THE INVENTION

1. Field of the Invention

This invention pertains to a tool, commonly referred to as a bit, for cutting and stripping insulation from an end portion of flexible conductor wire and for wrapping said end portion around a terminal post in a plurality of successive helical convolutions.

2. Description of the Prior Art

In the art of combination bits for cutting and stripping insulation from the end portion of flexible conductor wire and wrapping the stripped end portion on a terminal a number of inventions have been made pertaining to the configuration of the insulation cutter portion of the bit. U.S. Pat. Nos. 2,807,810; 3,554,243 and 4,076,056 disclose wrapping bits having a substantially U shaped notch formed therein for receiving the insulated wire to sever the insulation partially as withdrawal of the wire is commenced during the wrapping operation.

U.S. Pat. No. 3,696,482 also discloses a substantially U shaped groove for receiving the insulated end portion of a flexible conductor wire and also includes a transverse notch intersecting the groove to form sharp edges for cutting the insulation. U.S. Pat. No. 3,893,491 discloses a movable cutting edge or blade also for partially cutting into the insulation in response to rotation of the bit.

Other prior art bits for cutting and stripping insulation from conductor wires to be wrapped are disclosed in British Pat. No. 1,237,399 and U.S. Pat. Nos. 4,169,310 and 3,781,936, the last mentioned patent being assigned to the assignee of the present invention.

The bits disclosed in the last three patents mentioned above are characterized in that the cutting of the insulation is assisted by the stationary sleeve surrounding the bit which forces the insulated conductor wire into engagement with the bit cutting edge along with the action resulting from the withdrawal movement of the conductor wire as the bit is rotated to commence the wrapping operation. This cooperative action between the sleeve and the insulated end portion of the wire is critical to proper cutting of the insulation without nicking or otherwise damaging the wire and without tearing the insulation to leave a ragged end portion thereof. Even minor nicks or cuts in the conductor wire itself can cause stresses which will result in breakage of the wire during the wrap operation or as a result of attempting to remove the wire from a terminal.

Moreover, the movement of the bit with respect to its stationary sleeve and the cooperation of the cutting edge with the sleeve during initial rotation of the bit has been determined to be critical to proper cutting of the insulation and prevention of jamming of the wire between the bit and the sleeve. In this regard the configuration of the cutting edges on the bit and their angular relationship to the sleeve during the initial rotation of the bit to cut and strip the insulation and commence the wrapping cycle has been determined to be of considerable importance to provide the desired cutting action.

Accordingly in spite of a substantial number of inventions pertaining to improvements in combination conductor wrapping bits a problem of long standing has remained regarding proper insulation cutting and removal.

SUMMARY OF THE INVENTION

The present invention provides a combination cutting, stripping and wrapping bit for insulated conductor wire wherein an improved action of cutting a predetermined length of insulation from an end portion of the wire prior to the wrapping operation is provided without damaging the conductor itself and without jamming the conductor wire or the insulation between the rotary bit and a stationary sleeve surrounding the bit.

In accordance with the present invention an improved insulation cutting, stripping and wrapping bit is provided which is operable to initiate the insulation cutting action within a closely controlled amount of angular rotation of the bit with respect to a cooperating stationary sleeve at the onset of the bit operating cycle without damaging the conductor wire or creating ragged or torn insulation edges.

In accordance with the present invention a combination bit is provided for cutting and stripping a predetermined length of insulation from the end of a flexible conductor wire and wrapping the wire end portion on a terminal wherein an insulation cutting edge is provided which has a sloping, substantially straight portion for initially engaging the outer circumferential surface of the insulation and a substantially U shaped cutting edge portion which provides for cutting a greater portion of the annular transverse section of the insulation.

Further in accordance with the present invention a conductor wrapping bit is provided with a cutting edge which is operable to be parallel with a supporting surface of the cooperating stationary sleeve to provide an initial cutting action on the insulation which is smooth and does not tend to compress or squeeze the insulation. The initial cutting action is followed by entry of the conductor wire into a recess delimited by a U shaped cutting edge which together with a second sloped cutting edge portion results in more than half the total annular cross sectional area of the insulation to be cut thereby reducing the amount of insulation that has to be forcibly separated.

Still further in accordance with the present invention it has been determined that in a conductor wrapping bit of the type which cooperates with a stationary sleeve to at least partially cut the insulation of a flexible conductor wire that initial engagement of the cutting edge on the bit with the insulation should occur within a certain maximum amount of angular rotation of the bit with respect to its initial starting point.

The present invention still further provides an insulation cutting, stripping and wrapping bit which has a cutting edge configuration which upon initial engagement of the cylindrical outer surface of the insulation is tangent to said surface and then progressively forms a wedge or scissors action as the bit rotates with respect to a stationary sleeve to wrap a conductor wire around a terminal post.

The present invention provides an insulation cutting, stripping and wrapping bit which is superior in its ability to provide a more complete severing of the insulation without damaging the conductor wire or leaving ragged or torn portions of insulation and while also providing for a better quality wrapped wire connection to a terminal post.

DESCRIPTION OF THE PREFERRED EMBODIMENT

Figure 1:
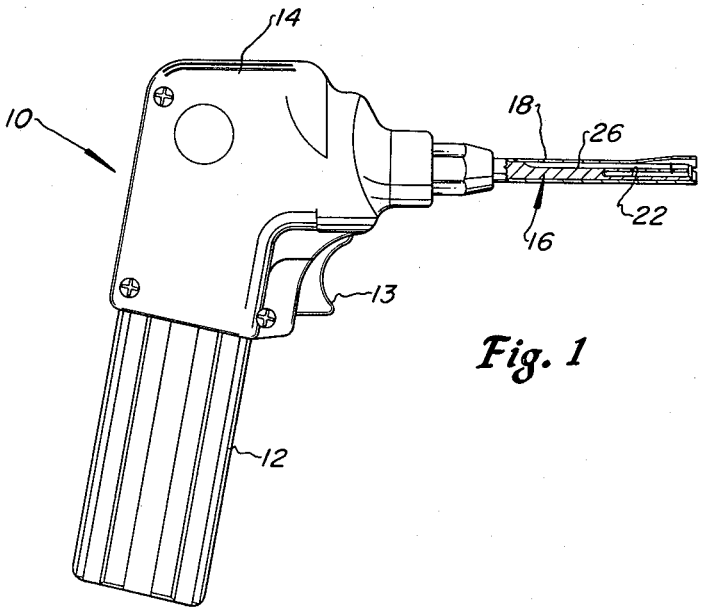
FIG. 1 is a side view, partially sectioned, of the conductor wrapping bit of the present invention in assembly with a portable rotary tool for driving the bit.

Referring to FIG. 1 of the drawing the improved conductor wrapping bit of the present invention is shown in connection with a rotary power tool generally designated by the numeral 10. The tool 10 illustrated is of the self contained electric type having a battery contained in a handle portion 12 for driving a suitable motor, not shown, disposed within the tool housing 14. The tool 10 is intended to be exemplary of the type of tool which may be suitably used with the present invention. Those skilled in the art will recognize that other types of tools including fluid operated as well as manually operated types may also be used for rotatably driving the improved conductor wrapping bit of the present invention.

The tool 10 is adapted to support and rotatably drive an improved bit, generally designated by the numeral 16, for cutting and stripping the insulation from an end portion of an insulated flexible conductor wire and wrapping said conductor wire on a terminal. The bit 16 is rotatably disposed within a stationary tubular sleeve 18 which is suitably mounted on the tool 10 in a known manner. The bit 16 is drivably connected to the aforementioned motor of the tool 10 in a well known manner, not shown. The bit 16 is cooperable with the sleeve 18 to operate on a flexible insulated conductor wire by cutting and stripping a predetermined length of insulation from an end portion of the conductor wire and wrapping the stripped end portion on a terminal post in a manner generally known in the art of conductor wrapping devices.

Figure 2:
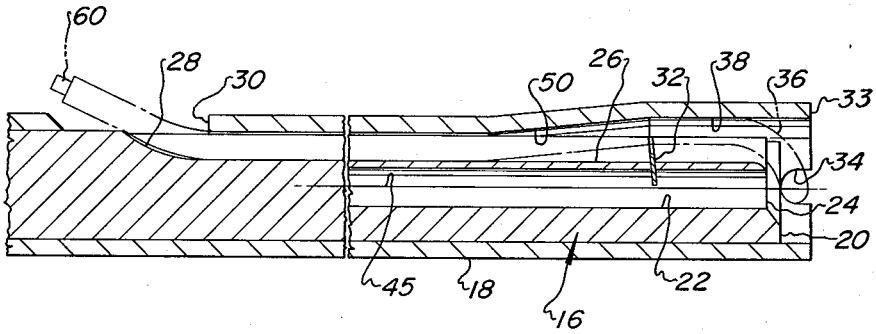
FIG. 2 is a longitudinal central section view of the bit and sleeve shown in FIG. 1.

Referring to FIG. 2 also the bit 16 includes a transverse end face 20 and an elongated terminal receiving bore 22 which opens to the end face. An open sided recess 24 is formed in the end face 20 and about the bore 22 to provide a wipe down surface for the end portion of a conductor wire during the coiling or wrapping of the wire on a terminal post in a known manner. The particular configuration of the end face is merely exemplary and it will be understood that the novel features of the improved cutting, stripping and wrapping bit of the present invention may be used with other wrapping bit end face designs.

The bit 16 is further characterized by an elongated conductor receiving groove 26 which is substantially parallel to and radially offset from the terminal receiving bore 22. The groove 26 has a generally U shaped cross sectional configuration, as shown in FIGS. 3 through 6, and opens to the periphery of the bit. The groove 26 also opens at one end to the recess 24 and the opposite end of the groove is characterized by a sloping surface portion 28 which as shown in FIG. 2 may be disposed adjacent to an opening 30 in the wall of the sleeve 18. The bit 16 also includes a substantially transversely disposed insulation cutting blade, generally designated by the numeral 32, spaced from the end face 20 and intersecting the groove 26. The spacing of the cutting blade 32 from the end face 20 provides for at least a partial convolution of insulated conductor to be wrapped on a terminal. The cutting blade 32 may be retained on the bit 16 by a suitable adhesive to fix the blade in the bit.

The tubular sleeve 18 substantially surrounds the bit 16 in close fitting relationship and encloses a major portion of the groove 26. The sleeve 18 includes a notch 34 opening to the distal end 33 of the sleeve for receiving the flexible insulated conductor wire, generally designated by the numeral 36, which is shown in phantom in FIG. 2. The conductor wire 36 is shown partially in phantom in FIGS. 3 through 6 except for the portion shown in cross section at the location of the cutter blade 32. The conductor wire 36 is characterized by a solid metal wire 60 of cylindrical cross section shape having an insulation covering 64 which is of annular cross section and may be made of one of a number of plastic materials. The sleeve 18 also includes a radially outwardly relieved wall portion 38 which extends axially away from the distal end 33 of the sleeve to the cutting blade 32. The relieved wall portion 38 forms a guide surface including a portion 50 which slopes radially inwardly with respect to the longitudinal axis of the bit. The guide surface formed by the wall portion 38 provides for insertion of the insulated conductor wire longitudinally from the distal end 33 of the sleeve past the cutting blade 32, into the groove 26, and toward the opening 30 in the sleeve as shown in FIG. 2.

Figure 3:
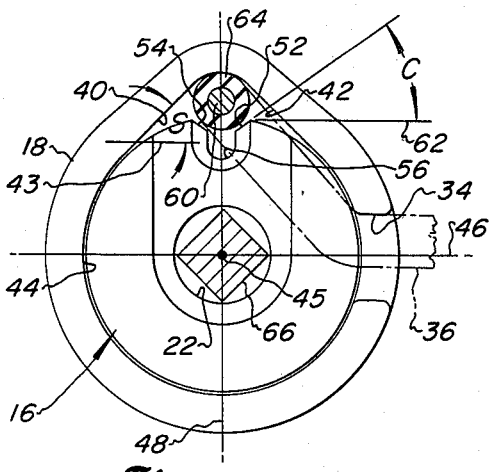
FIG. 3 is a transverse end view of the bit and sleeve showing a bit in its starting position with respect to the sleeve and showing an insulated conductor wire in position preparatory to the commencement of an operating cycle.

Referring now to FIG. 3 the wall portion 38 is formed as an arcuate surface which blends with adjoining planar surface portions 40 and 42 adjacent to the cutting blade 32. The surface 40 is formed at an angle S with respect to a line 43 which is parallel to a plane passing through the longitudinal axis of rotation of the bit, designated by the numeral 45 in FIG. 3, which is also the center of the cylindrical inner surface portion 44 of the sleeve 18. In FIG. 3, the aforementioned plane is defined by a line 46 which is perpendicular to a radial line 48 passing through the radially outer most point on the surface formed by the wall portion 38 and intersecting the axis 45. The line 48 also, in the position of the bit 16 shown in FIG. 3, bisects a recess defined by a U-shaped cutting edge 56. The angle S is shown particularly for the surface 40 because, as will be explained further herein, the surface 40 co-acts with a portion of the cutting blade 32 to initially cut the insulation and guide the conductor wire into the recess formed by the cutting edge 56.

In the preferred embodiment of the present invention the surfaces 40 and 42 are tangent to the arcuate surface formed by the wall portion 38 and the cylindrical inner wall surface 44 of the sleeve 18. The portion of the sleeve comprising the planar or flat surfaces 40 and 42 and the wall portion 38 may be formed by a suitable coining or other metal displacing operation to form said surfaces in the vicinity of the cutting blade in the bit.

Alternatively the surfaces 40 and 42 and the wall portion 38 could be formed by machining a thick walled sleeve, for example. The surfaces 38, 40 and 42 extend axially from the distal end 33 of the sleeve at least to and preferably slightly beyond the blade 32 whereupon said surfaces then transform into to the cylindrical inner wall surface 44.

Figure 4:
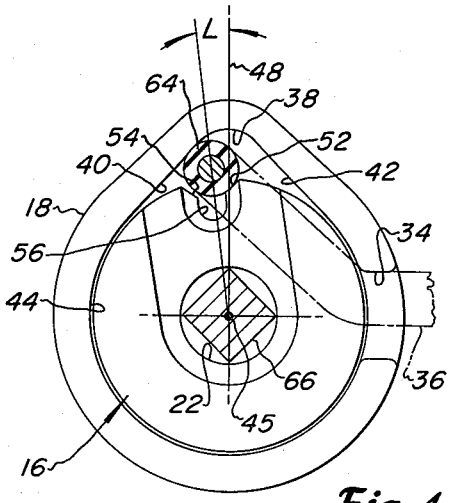
FIG. 4 is a view similar to FIG. 3 showing the relative position of the bit, sleeve, and the insulated conductor wire after an initial critical amount of angular rotation of the bit.
Figure 5:
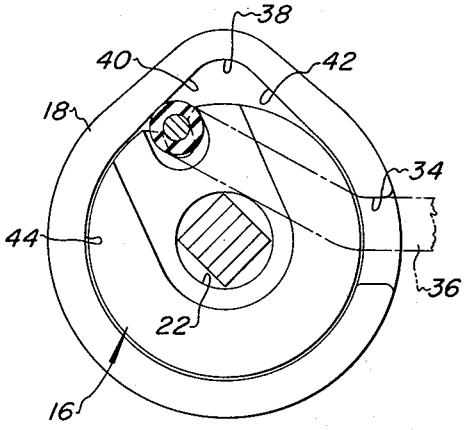
FIG. 5 is a view similar to FIG. 4 showing the bit in a position of further angular displacement; and, FIG. 6 is a view similar to FIG. 5 showing the bit in a position of still further angular displacement.
Figure 6:
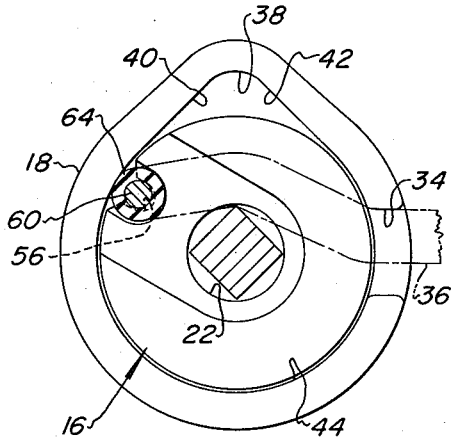

The cutter blade 32 includes opposed cutting edge portions 52 and 54 which intersect the cylindrical outer surface of the bit 16 as shown in FIGS. 3 through 6, which cutting edges converge toward each other and intersect the recess in the cutter blade formed by the substantially U-shaped cutting edge 56. The cutting edge 56 is proportioned in such a way that when an insulated conductor wire 36 is substantially fully seated in the bottom of the groove 26, as shown in FIG. 6, there is a slight clearance between the bottom of the cutting edge 56 and the metal conductor wire 60 itself to prevent forcible engagement and nicking of the wire as it is withdrawn from the groove during the wrapping operation.

In the position shown in FIG. 3, which is the position the bit 16 assumes preparatory to insertion of a conductor 36 into the groove 26, the cutting edge portion 52 forms an angle C with respect to a line 62 parallel to the line 46. The cutting edge portion 54 may also form the same angle with respect to the line 62 in the opposite sense although the angle formed by the cutting edge portion 54 is not of primary importance to the performance of the bit if the bit is only to be used for rotation in the direction indicated in the drawings.

When the conductor 36 is inserted in the bit as shown in FIGS. 2 and 3, it may be resting on the cutting edges 52 and 54 or disposed slightly above the cutting edges, as shown in FIG. 3, due to the stiffness of the conductor and as a result of the conductor being forced along the guide surfaces formed by the wall portions 38 and 50, past the blade 32, and into the groove 26. Nevertheless, the sleeve 18 is proportioned such that as the rotation of the bit is commenced, as shown in FIG. 4, the cutting edge 52 engages the outer circumference of the conductor insulation 64 within an amount of angular rotation indicated by the angle L measured about the center of rotation which is the axis 45.

At the point of contact of the cutting edge 52 with the outer circumference of the insulation 64 the cutting edge 52 is preferably parallel to the surface 40 which also causes the cutting edge 52 to be tangent to the outer circumferential surface of the conductor insulation as shown in FIG. 4.

As the bit 16 continues to rotate from the position indicated in FIG. 4 to the position shown in FIG. 5 the angular relationship of the cutting edge 52 with respect to the surface 40 changes to that which provides a wedging or scissors action with respect to the conductor insulation 64 and a clean cut of the insulation is commenced by the cutting edge 52. Moreover, as the bit 16 rotates to the position shown in FIG. 5 the conductor 36 is cammed by the surface 40 down into the recess formed by the U-shaped cutting edge 56 and additional cutting action is provided by that portion of the cutter blade 32. As shown in FIG. 5 the cutting edge 54 has also cut into the insulation on the opposite side of the conductor wire portion 60. As the bit 16 continues to rotate from the position shown in FIG. 5 to the position shown in FIG. 6 the conductor 36 is cammed and drawn fully down into the recess delimited by the U-shaped cutting edge 56. The conductor 36 in the position shown in FIG. 6, has also begun engagement with a terminal 66. Moreover, throughout the rotation of the bit 16 the conductor 58 is held stationary with respect to the sleeve 18 within the notch 34. Accordingly, as rotation of the bit 16 approaches the position shown in FIG. 6 the stripping of the insulation 64 in the groove 26 between the cutter blade 32 and the opening 30 is commenced as the conductor is forced to be withdrawn from the groove by the coiling or winding action of the conductor around the terminal.

It has been determined in the development of the present invention that the angle L is preferably approximately five degrees. Furthermore in order for the cutting edge 52 to be parallel to the surface 40 as the edge engages the circumferential surface of the insulation 64 the angle C must be the difference between the angle S and the angle L. It has further been determined that the tolerance for angle C is not uniformly distributed on either side of the derived value for the angle. It is indicated that the tolerance on the value of angle C is permissible in the direction which gives a greater value than the derived value. Accordingly if the cutting edge 52 is to engage the circumferential surface of the conductor insulation when the bit has reached the rotational position indicated in FIG. 4 it is permissable that the edge 52 has commenced the wedging or scissors action on the insulation. It is preferable, however, that the wedging action between the cutting edge 52 and the surface 40 does not commence at the point where the cutting edge first engages the insulation of the conductor as indicated by the position of the bit and the conductor with respect to each other shown in FIG. 4. On the other hand if the angle C is too shallow the conductor will not be suitably engaged by the cutter but will have a tendency to remain in the position shown in FIG. 3 and will be caught between the longitudinal edge of the groove 26 and the sleeve inner wall 44 and be severed or cause the bit to jam within the sleeve.

It has further been determined in accordance with the present invention that cutting, stripping and wrapping bit and sleeve combinations for wrapping insulated conductors in the range of from 22 to 30 American Wire Gauge sizes with various types of insulation and insulation outside diameters that certain dimensional relationships must be maintained in order for the conductor wire to be operated on properly by the bit during the initial insulation cutting and stripping phase of operation. It has been determined for example that for bits designed to operate on conductor wires in the above cited range of wire gauges that the diametral clearance between the outside diameter of the bit and the inside cylindrical surface 44 of the sleeve should be limited to a maximum of approximately 0.063 mm. Moreover, it has further been determined that when the bit is in the starting position shown in FIG. 3 the clearance between the outside diameter of the insulation 64 and the cutting edges 52 and 54, as measured at the closest position of the cutting edges 52 and 54 with respect to the insulation, should be sufficient to permit relatively easy insertion of the conductor wire into the sleeve entry funnel formed by the wall portions 38 and past the cutting edges 52 and 54 and yet also permit the proper operation of the bit to perform cutting and stripping of the insulation without jamming the conductor between the bit and the inside surfaces of the sleeve, without damaging the conductor wire 60 itself, and without leaving torn and ragged edges of the insulation 64 at the point of separation of the insulation portion that is stripped from the conductor 36.

The operation of the bit 16 in conjunction with the tool 10 is carried out in known manner. The tool 10 includes suitable mechanism, not shown, which may be of a well known type which after each operating cycle of the tool will position the bit 16 with respect to the sleeve 18 as indicated by the relative positions shown in FIG. 3. Prior to initiating another operating cycle of the tool 10 the end portion of a solid insulated conductor 36 is inserted into the end of the sleeve along the wall portion 38 and past the cutting blade 32 and into the groove 26 until the distal end of the conductor projects slightly through the opening 30 as shown in FIG. 2 of the drawings. The conductor is then pulled into the notch 34 as shown in FIGS. 2 and 3 and an actuating trigger 13 of the tool is depressed to cause the tool motor to commence rotation of the bit 16 with respect to the sleeve 18.

A bit and sleeve in accordance with the teachings of the present invention, upon commencement of rotation of the bit, will cut and strip a portion of insulation 64 between the cutting blade 32 and the opening 30 from the end of the conductor 36 as the conductor is withdrawn from the groove 26 and wrapped around a terminal such as the terminal 66 shown in FIGS. 3 through 6. During initial rotation of the bit 16 the end portion of the conductor 36 protruding from the opening 30 in the sleeve will also be severed by the cutting action of a suitable cutting surface formed by the longitudinal edges of the opening in a known manner. After the conductor 58 is wrapped in a series of helical convolutions around the terminal the tool 10 is withdrawn from the terminal and the trigger 13 is released whereby the aforementioned mechanism for positioning the bit 16 will operate to index the bit to the position indicated by FIGS. 2 and 3 of the drawings. Another operating cycle of the tool 10 may be commenced by inserting the end of a conductor into the groove 26 as described hereinabove whereupon the portion of insulation remaining in the groove from the previous operating cycle will be pushed out through the opening 30 in a known manner.

The long standing problem of providing a structurally uncomplicated conductor wrapping bit for performing satisfactory insulation cutting and stripping operations in combination with the wrapping operation has been, it is verily believed, solved by the teachings of the present invention.

What we claim is:

1. In a device for stripping insulation from a flexible conductor wire and wrapping said wire on a terminal in a series of helical convolutions:

a rotatable wrapping bit having an elongated cylindrical body and including groove means forming a longitudinal conductor wire receiving groove disposed along the periphery of said bit and radially displaced from the axis of rotation from said bit;

an elongated cylindrical tubular sleeve, said sleeve including guide surface means forming a guide surface extending generally axially from one end of said sleeve and positioned to be in alignment with said groove means in a starting position of said bit with respect to said sleeve to provide for inserting an insulated conductor wire into said groove means; said guide surface having a substantially flat surface portion, and, insulation cutting means interposed in said groove means, said insulation cutting means including a first substantially straight cutting edge portion, oriented relative to said guide surface means such that, at the point of contact of said cutting edge portion with the flexible conductor insulation, said cutting edge portion is essentially parallel to said substantially flat surface portion of said guide surface means for forcibly engaging said insulated conductor wire between said first cutting edge portion and said substantially flat surface portion upon initial rotation of said bit to commence cutting said insulation.

2. The invention set forth in claim 1 wherein:

said insulation cutting means includes a substantially U shaped cutting edge portion interposed in said groove and intersecting said first cutting edge portion.

3. The invention set forth in claim 2 wherein:

said U shaped cutting edge portion includes a curved portion forming the bottom of said U-shaped cutting edge portion and which is spaced from said groove a distance slightly less than the thickness of insulation on said conductor wire.

4. The invention set forth in claim 2 together with:

a second substantially straight cutting edge portion intersecting said U-shaped cutting edge portion and opposite said first cutting edge portion.

5. The invention set forth in claim 1 wherein:

said guide surface means on said sleeve is formed by a curved interior wall portion of said sleeve, and said surface means includes a substantially flat surface portion formed between said curved interior wall portion and a generally cylindrical interior surface of said sleeve.

6. The invention set forth in claim 5 wherein: said guide suface means and said substantially flat surface portion of said sleeve are positioned in such a way in relation to said first cutting edge portion on said bit so as to provide for engagement of said insulation by said first cutting edge portion when an initial angular increment of rotation of said bit with respect to said sleeve is within approximately five degrees.

7. The invention set forth in claim 6 wherein:

said first cutting edge portion on said bit is formed at an angle with respect to a line perpendicular to a line passing through the radially outer most point on said guide surface means with respect to the axis of rotation of said bit and intersecting said axis when said bit is in said starting position with respect to said sleeve, which angle provides for said first cutting edge portion to be parallel to said flat surface portion on said sleeve when said first cutting edge portion initially engages the insulation on said conductor wire.

8. The invention set forth in claim 7 wherein:

said flat surface portion is formed at an angle with respect to said line perpendicular to a line passing through the radially outer most point on said guide surface means with respect to the axis of rotation of said bit, which angle is equal to the sum of said angle formed by said first cutting edge portion plus said initial angular increment of rotation of said bit.

9. The invention as set forth in claim 1, wherein at the point of contact of said cutting edge portion with the flexible conductor insulation, the angle between a plane bisecting said wrapping bit groove means and a plane bisecting said guide surface means, both of said planes passing through the axis of rotation of said bit, is approximately five degrees.

10. In a device for stripping insulation from a flexible conductor wire and wrapping said wire on a terminal in a series of helical convolutions:

a rotatable wrapping bit having an elongated cylindrical body and including groove means forming a longitudinal conductor wire receiving groove disposed along the periphery of said bit and radially displaced from the axis of rotation from said bit;

an elongated cylindrical tubular sleeve, said sleeve including a radially outwardly displaced tubular wall portion forming a guide surface extending generally axially from one end of said sleeve and positioned to be in substantial alignment with said groove means in a starting position of said bit with respect to said sleeve to provide for inserting an insulated conductor wire into said groove means, said wall portion being characterized by a curved inner surface of said sleeve contiguous with a substantially flat surface portion between said curved inner surface and a generally cylindrical inner wall of said sleeve; and an insulation cutting blade interposed in said groove means, said insulation cutting blade including a first substantially straight cutting edge portion, oriented relative to said flat surface portion of said sleeve such that, at the point of contact of said cutting edge portion with the flexible conductor insulation, said cutting edge portion is essentially parallel to said flat surface portion for forcibly engaging said insulated conductor wire between said first cutting edge portion and said flat surface portion upon initial rotation of said bit to commence cutting said insulation.

11. The invention set forth in claim 10 wherein:

said insulation cutting blade includes a substantially U-shaped cutting edge portion interposed in said groove and intersecting said first cutting edge portion and a second substantially straight cutting edge portion intersecting said U-shaped cutting edge portion and opposite said first cutting edge portion.

12. The invention set forth in claim 11 wherein:

in a starting position of said bit with respect to said sleeve the clearance between the outer circumference of an insulated conductor wire and said first and second cutting edge portions measured in a plane perpendicular to the axis of rotation of said bit when said conductor wire is disposed along said guide surface is no more than the amount required to permit relatively easy insertion of said insulated conductor wire past said cutting edge portions and into said groove.

13. The invention as set forth in claim 10, wherein said sleeve flat surface portion is oriented at an angle "S" with respect to a line that is normal to a plane that bisects said curved inner surface of said sleeve.

14. The invention set forth in claim 13, wherein said cutting blade first substantially straight cutting edge portion is oriented at an angle "C" with respect to a line that is normal to a plane that bisects said wrapping bit groove means in accordance with the relationship:

$$C=S-L,$$

where L is the initial angular increment of rotation from said starting position of said wrapping bit with respect to said cylindrical tubular sleeve.

* * * * *